US006509887B1

(12) United States Patent
Kondoh et al.

(10) Patent No.: US 6,509,887 B1
(45) Date of Patent: Jan. 21, 2003

(54) ANTI-FERROELECTRIC LIQUID CRYSTAL DISPLAY AND METHOD OF DRIVING THE SAME

(75) Inventors: Shinya Kondoh, Tokorozawa (JP); Shigekazu Takahashi, Kawaguchi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/242,491

(22) PCT Filed: Jun. 19, 1998

(86) PCT No.: PCT/JP98/02759

§ 371 (c)(1),
(2), (4) Date: Feb. 19, 1999

(87) PCT Pub. No.: WO98/59274

PCT Pub. Date: Dec. 30, 1998

(30) Foreign Application Priority Data

Jun. 20, 1997 (JP) ..... 9-164151

(51) Int. Cl.[7] ..... G09G 3/36

(52) U.S. Cl. ..... 345/87; 345/88; 345/89; 345/97; 345/98; 345/100; 345/94; 345/95; 345/208

(58) Field of Search ..... 345/97, 100, 102, 345/98, 87, 95, 88, 89, 94, 96, 208; 349/174

(56) References Cited

U.S. PATENT DOCUMENTS 4,975,691 A * 12/1990 Lee ..... 340/781
5,121,233 A * 6/1992 Spencer et al. ..... 359/54
5,459,481 A 10/1995 Tanaka ..... 345/95
5,995,181 A * 11/1999 Imoto ..... 345/97
6,008,787 A * 12/1999 Konodeh ..... 345/97
6,072,453 A * 9/2000 Okamoto et al. ..... 345/97
6,115,091 A * 9/2000 Konodeh et al. ..... 345/97

FOREIGN PATENT DOCUMENTS

| | | |
|---|---|---|
| EP | 0 272 079 | 6/1988 |
| EP | 0 478 186 | 4/1992 |
| EP | 0 708 553 | 4/1996 |
| EP | 0 709 717 | 5/1996 |
| EP | 0 768 557 | 4/1997 |

* cited by examiner

*Primary Examiner*—Richard Hjerpe
*Assistant Examiner*—Ali Zamani
(74) *Attorney, Agent, or Firm*—Finnegan, Henderson, Farabow, Garrett & Dunner, L.L.P.

(57) ABSTRACT

An antiferroelectric liquid crystal display comprises: an antiferroelectric liquid crystal display element which includes an antiferroelectric liquid crystal that is sandwiched between a pair of substrates having a plurality of scanning electrodes and signal electrodes deposited respectively on the opposing surfaces thereof; and a light source which successively emits a plurality of different colors of light. In the thus constructed antiferroelectric liquid crystal display, a scanning period (TS) during which the light source emits light of one of the plurality of colors is divided into two periods, of which the first period (SC1) includes a selection period for determining a display state and a non-selection period for holding therethrough the display state selected during the selection period, and the second period (SC2), constituting the remainder of the scanning period, includes a selection period for forcing the display state into a black display state and a non-selection period for holding therethrough the black display state selected during the selection period.

15 Claims, 14 Drawing Sheets

(b) SECOND EMISSION FRAME (a) FIRST EMISSION FRAME

ANTI-FERROELECTRIC LIQUID CRYSTAL DISPLAY AND METHOD OF DRIVING THE SAME

TECHNICAL FIELD

The present invention relates to an antiferroelectric liquid crystal display constructed using a light source capable of emitting light of a plurality of different colors, in combination with a liquid crystal panel, a liquid crystal optical shutter array, or like component having a matrix of pixels formed from a liquid crystal layer consisting of an antiferroelectric liquid crystal. The invention also relates to a method of driving such an antiferroelectric liquid crystal display.

BACKGROUND ART

Heretofore, various methods have been proposed for accomplishing color display using a liquid crystal cell as a shutter and utilizing a successive additive color mixing phenomenon by placing a light emitting device (such as an LED or CRT) behind the shutter. Prior art literature relating to such methods includes, for example, 7–9 "4 A Full-Color Field-Sequential Color Display" presented by Philip Bos, Thomas Buzak, Rolf Vatne et al. at Eurodisplay '84 (1984/9/18–20). This display method produces color display by projecting differently colored lights in rapid succession, unlike methods that use color filters with the respective color segments provided at each pixel position. For the liquid crystal cell used with this method, the same structure as that of a cell used for monochrome display can be used. The light emitting device disposed behind the liquid crystal cell emits light of three primary colors, for example, R (red), G (green), and B (blue), which are successively projected onto the liquid crystal cell, each color for a predetermined duration of time (TS). That is, light of each color is projected onto the liquid crystal cell for the duration of time TS, in the order of R (red), G (green), and B (blue). These three primary colored lights are successively and repeatedly projected. The liquid crystal cell is controlled in synchronism with the time TS to vary the light transmittance of each display pixel. More specifically, the light transmittance for each of R, G, and B is determined by driving the liquid crystal cell in accordance with display color information. As an example, the light transmittance of the liquid crystal cell is set and held at 50% when R is being emitted for time TS, at 70% when G is being emitted for time TS, and at 90% when B is being emitted for time TS. Since the time TS is usually very short, the human eye does not perceive the respective colors as individually separate colors but as one color produced by mixing the respective colors.

Techniques utilizing such a method for ferroelectric liquid crystal display devices are disclosed in Japanese Patent Unexamined Publication Nos. 63-85523, 63-85524, and 63-85525. However, no literature has been found that describes a specific driving method that applies such a method to antiferroelectric liquid crystal display devices.

Antiferroelectric liquid crystals exhibit ferroelectricity in the presence of a sufficient electric field, but in the absence of an external electric field, etc., they exhibit characteristics significantly different from the characteristics of ferroelectric liquid crystals. Accordingly, a driving method that matches the characteristics of antiferroelectric liquid crystals becomes necessary to drive antiferroelectric liquid crystal display devices. Much research has been conducted on liquid crystal display devices using antiferroelectric liquid crystals since it was reported in Japanese Patent Unexamined Publication No. 2-173724 by Nippondenso and Showa Shell Sekiyu that such liquid crystal devices provided wide viewing angles, were capable of fast response, and had good multiplexing characteristics.

DISCLOSURE OF THE INVENTION

In driving an antiferroelectric liquid crystal for color display utilizing the successive additive color mixing phenomenon, the time during which the light emitting device mounted as a light source behind the liquid crystal shutter emits light of one particular color is defined as TS, as described above. In order that changes in the color of light emitted from the light emitting device will not be perceived as flicker by the human eye when the R, G, and B colored lights are sequentially emitted from the light emitting device, the time TS must be made shorter than about 20 ms.

According to a prior art driving method for antiferroelectric liquid crystal, the amount of light transmitted through a pixel during the time TS varies depending on which scan line the pixel is located. Consider, for example, a case where the entire liquid crystal display screen is displayed in white. In this case, since the display color is white, the liquid crystal is driven so that the light transmittance for each of R, G, and B becomes 100% for all pixels. During the time TS that R is being emitted, for example, a drive voltage is applied to the respective scanning electrodes. G is emitted for the next duration of time TS, followed by the emission of B for the duration of time TS, and the liquid crystal is driven accordingly for the respective durations of time TS to produce the desired color (in this case, white) for display. However, since the timing at which the selection voltage described later is applied to the selected scanning electrode becomes slightly displaced from one scanning electrode to the next, the length of time that the pixels on the scanning electrodes X1, X2, . . . , Xn transmit the light of R during the time TS that the light of R is being emitted, becomes gradually shorter as the scanning progresses from top to bottom and, at the bottommost scanning electrode, the pixel transmits the light of R only for a short period of time. If the length of time that a pixel transmits light, that is, the amount of transmitted light, differs depending on the position of the scanning electrode associated with that pixel, the entire screen cannot be displayed with uniform brightness, nor can the color be controlled, rendering it impossible to display the desired color. For example, since the pixels on the bottommost scanning electrode transmit the light of R only for a short period of time, the amount of light of R decreases and a color different from white is displayed.

The present invention is aimed at resolving the above-described problem, and provides an antiferroelectric liquid crystal display and a method of driving the same using the successive additive color mixing phenomenon for color display which can display the entire screen with uniform brightness and can achieve the display of the desired color.

According to the present invention, there is provided an antiferroelectric liquid crystal display comprising: an antiferroelectric liquid crystal display element which includes an antiferroelectric liquid crystal that is sandwiched between a pair of substrates having a plurality of scanning electrodes and signal electrodes deposited respectively on the opposing surfaces thereof; and a light source which successively emits a plurality of different colors of light, wherein a scanning period (TS) during which the light source emits light of one of the plurality of colors is divided into two periods, of which the first period (SC1) includes a selection period for determining a display state and a non-selection period for holding therethrough the display state selected during the selection period, and the second period (SC2), constituting the remainder of the scanning period, includes a selection period for forcing the display state into a black display state and a non-selection period for holding therethrough the black display state selected during the selection period.

According to the present invention, there is also provided an antiferroelectric liquid crystal display comprising: an antiferroelectric liquid crystal display element which includes an antiferroelectric liquid crystal that is sandwiched between a pair of substrates having N scanning electrodes and M signal electrodes deposited respectively on the opposing surfaces thereof; and a light source which successively emits a plurality of different colors of light, wherein a period (TS) during which the light source emits light of one of the plurality of colors is made up of an even number of scanning periods, wherein, in an odd-numbered scanning period, forward scanning is performed by scanning the scanning electrodes forward, starting at the first scanning electrode and progressing toward the N-th scanning electrode, and, in an even-numbered scanning period, backward scanning is performed by scanning the scanning electrodes backward, starting at the N-th scanning electrode and progressing toward the first scanning electrode. The forward scanning and the backward scanning may be interchanged.

In a preferred embodiment of the antiferroelectric liquid crystal display of the present invention, in a period (TS) during which the light source emits light of one of the plurality of colors, forward scanning is performed by scanning the scanning electrodes forward, starting at the first scanning electrode and progressing toward the N-th scanning electrode, and in a period (TS) during which the light source emits light of the same color the next time, backward scanning is performed by scanning the scanning electrodes backward, starting at the N-th scanning electrode and progressing toward the first scanning electrode, wherein the forward scanning and the backward scanning are repeated alternately.

ADVANTAGEOUS EFFECT OF THE INVENTION

According to the antiferroelectric liquid crystal display of the present invention and its driving method, a uniform display can be produced with the entire display screen free from nonuniformity in brightness. Furthermore, the desired color can be displayed since the color can be controlled accurately.

DETAILED DESCRIPTION OF THE INVENTION

Figure 1:
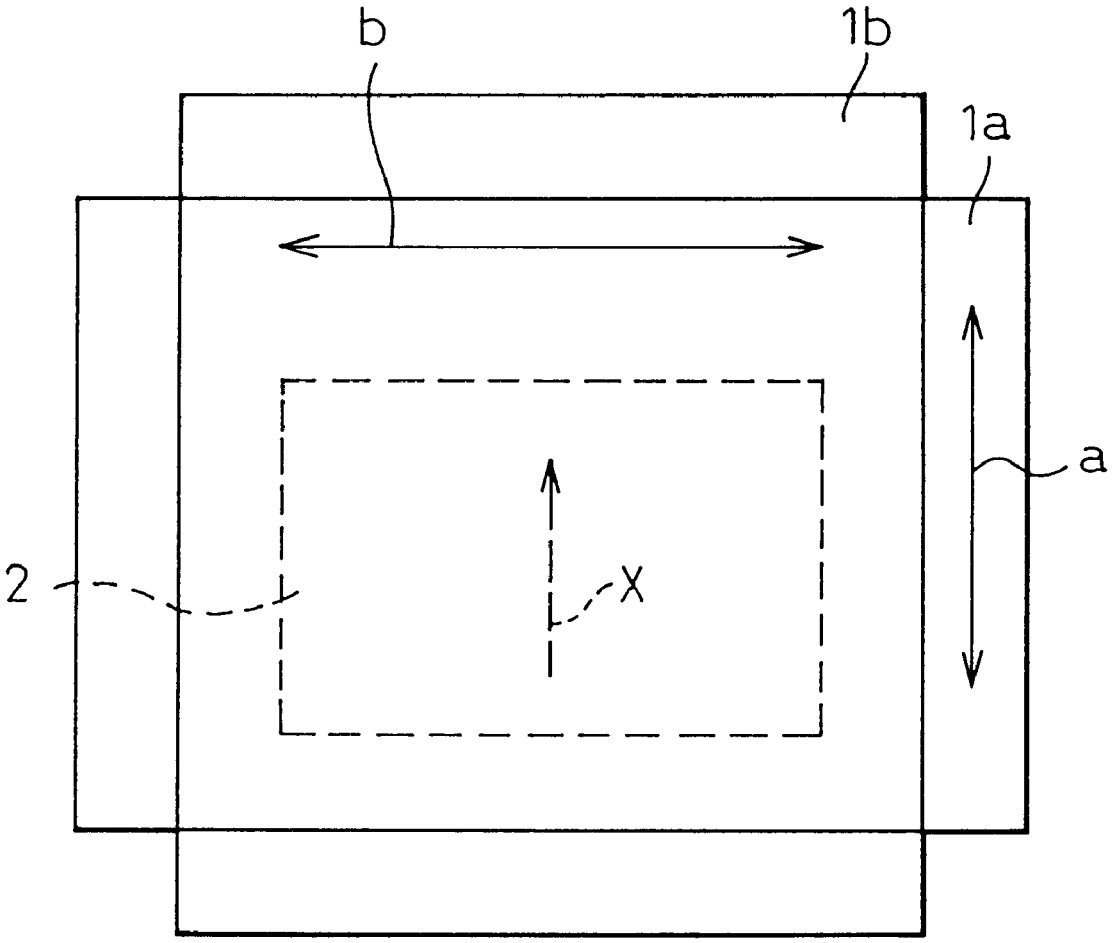
FIG. 1 is a diagram showing the arrangement of an antiferroelectric liquid crystal cell and polarizers.

FIG. 1 is a diagram showing the arrangement of polarizers when an antiferroelectric liquid crystal is used as a liquid crystal display element. Between the polarizers 1*a* and 1*b* arranged in a crossed Nicol configuration is placed a liquid crystal cell 2 in such a manner that the average long axis direction of molecules in the absence of an applied voltage is oriented substantially parallel to either the polarization axis, a, of the polarizer la or the polarization axis, b, of the polarizer 1*b*. Then, the liquid crystal cell is set up so that black is displayed when no voltage is applied and white is displayed when an electric field is applied.

Figure 2:
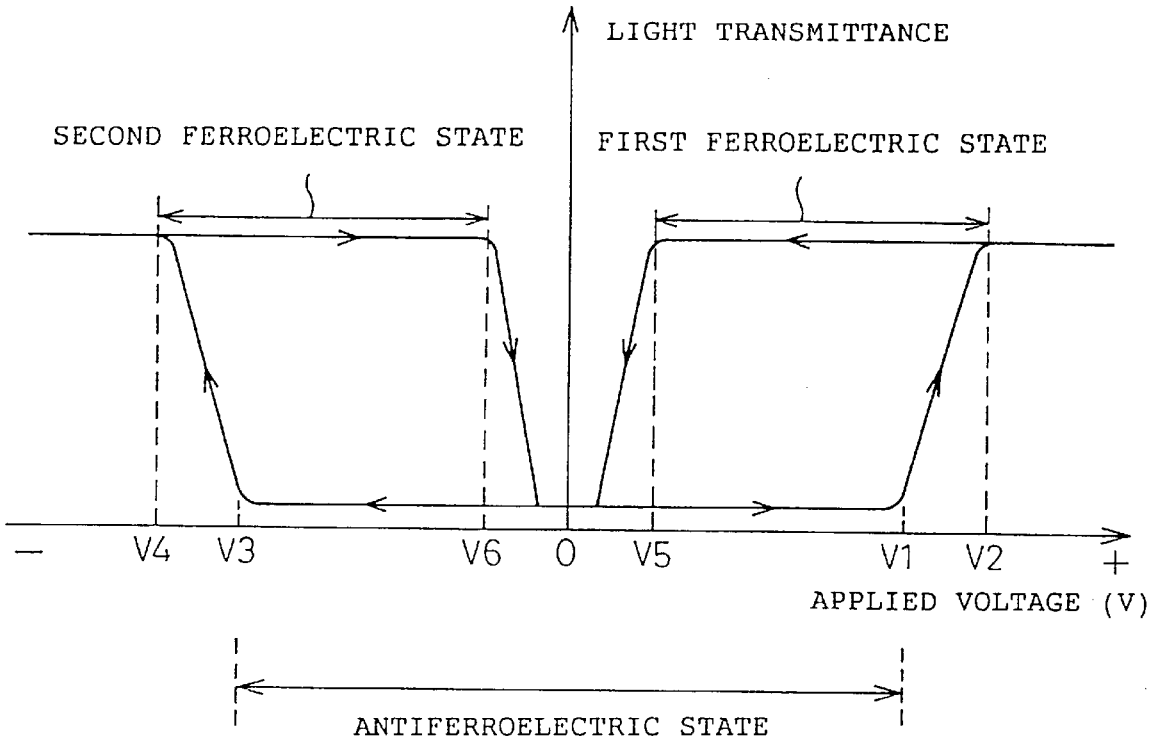
FIG. 2 is a diagram showing how the light transmittance of an antiferroelectric liquid crystal display element varies with an applied voltage.

When a voltage is applied across the thus structured liquid crystal cell, its light transmittance varies with the applied voltage, describing a loop as plotted in the graph of FIG. 2. The voltage value at which the light transmittance begins to change when the applied voltage is increased is denoted by V1, and the voltage value at which the light transmittance reaches saturation is denoted by V2, while the voltage value at which the light transmittance begins to drop when the applied voltage is decreased is denoted by V5; further, the voltage value at which the light transmittance begins to change when a voltage of opposite polarity is applied and the absolute value of the applied voltage is increased, is denoted by V3, and the voltage value at which the light transmittance reaches saturation is denoted by V4, while the voltage value at which the light transmittance begins to change when the absolute value of the applied voltage is decreased is denoted by V6. As shown in FIG. 2, a first ferroelectric state is selected when the value of the applied voltage is greater than the threshold of the antiferroelectric liquid crystal molecules. When the voltage of the opposite polarity greater than the threshold of the antiferroelectric liquid crystal molecules is applied, a second ferroelectric state is selected. In either of these ferroelectric states, when the voltage value drops below a certain threshold, an antiferroelectric state is selected. The antiferroelectric liquid crystal display can be constructed to produce a black display in the antiferroelectric state or a white display in the antiferroelectric state. The present invention is applicable to both modes of operation. The description hereinafter given assumes that the display is set up to produce a black display in the antiferroelectric state.

Figure 3:
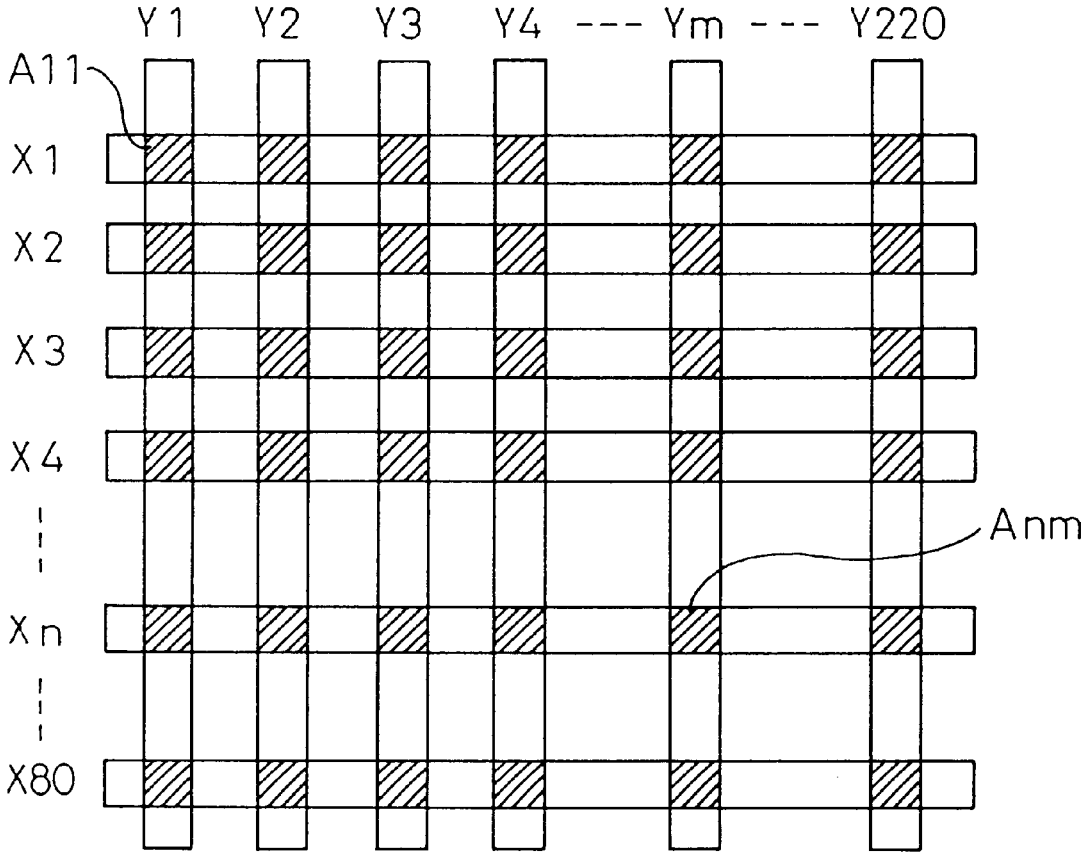
FIG. 3 is a diagram showing scanning electrodes and signal electrodes formed in a matrix array.

Next, a conventional liquid crystal driving method for an antiferroelectric liquid crystal will be described. FIG. 3 is a diagram showing an example of an electrode arrangement in a liquid crystal panel having scanning electrodes and signal electrodes arranged in a matrix form on substrates. This electrode arrangement comprises the scanning electrodes (X1, X2, X3, . . . , Xn, . . . X80) and signal electrodes (Y1, Y2, Y3, . . . . , Ym, . . . , Y220), and shaded portions where the scanning electrodes and signal electrodes intersect are pixels (All, Anm). A voltage is applied to the scanning electrodes in sequence one scanning line at a time, in synchronism with which voltage waveforms corresponding to the display states of the associated pixels are applied from the signal electrodes, and the display state of each pixel is written in accordance with a composite waveform produced by compositing the voltage waveforms applied to the associated signal electrode and the selected scanning electrode.

Figure 4:
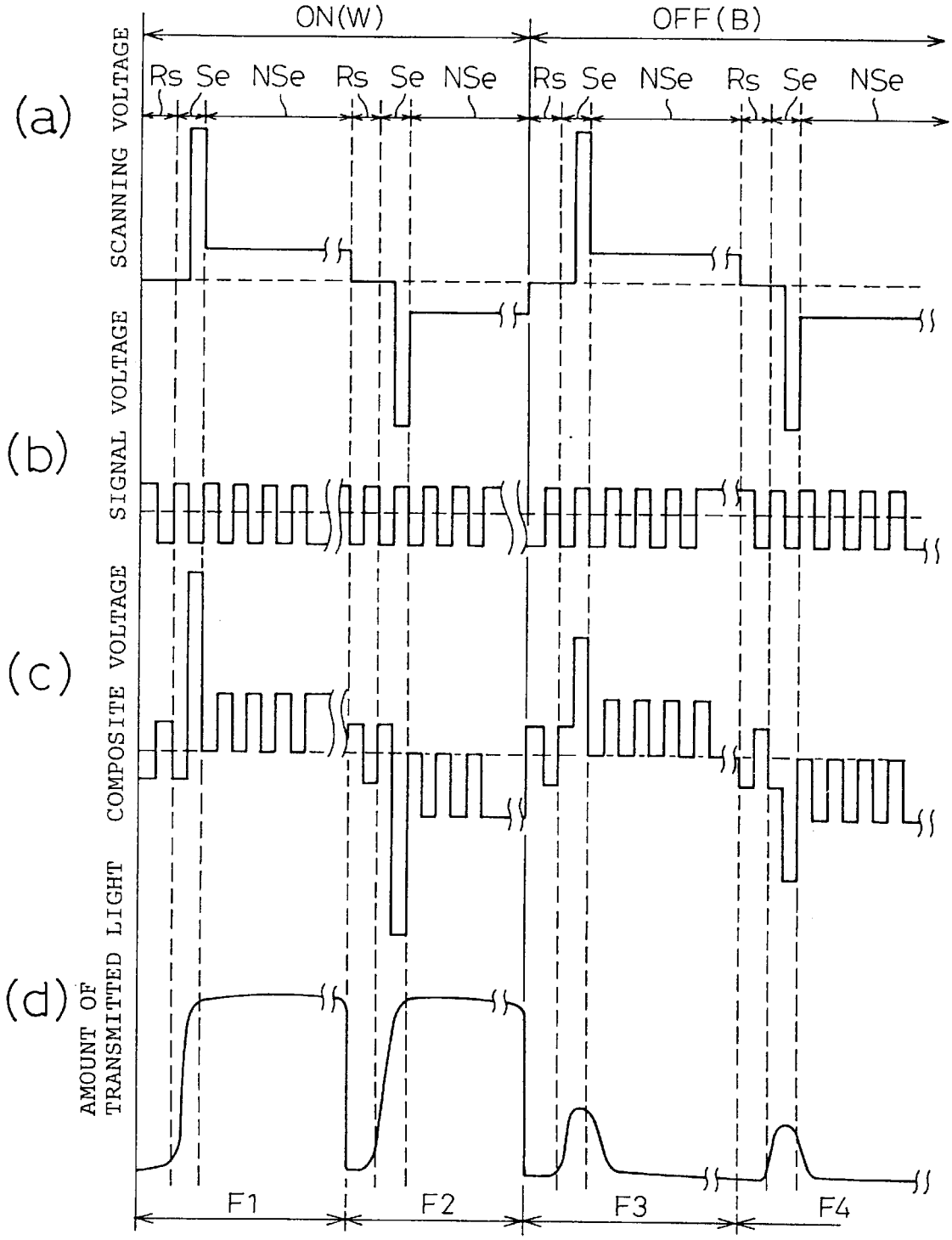
FIG. 4 is a diagram showing voltage waveforms applied to a scanning electrode, signal electrode, and pixel, and their corresponding light transmission amount, according to a prior art driving method.

Writing to the pixel is accomplished, as shown in FIG. 4, by applying a scanning voltage (a) to the scanning electrode (Xn) and a signal voltage (b) to the signal electrode (Ym) and thereby applying the resulting composite voltage (c) to the pixel (Anm). In FIG. 4, the first or second ferroelectric state or the antiferroelectric state is selected in a selection period (Se), and the selected state is held throughout the following non-selection period (NSe). That is, a selection pulse is applied in the selection period (Se), and the transmission light amount (transmittance) (d) obtained as the result of the selection is maintained throughout the following non-selection period (NSe) to produce the display.

In an antiferroelectric liquid crystal display device, it is generally practiced to reset a pixel state to the first or second ferroelectric state or the antiferroelectric state immediately before writing to the pixel. In FIG. 4, for example, each selection period (Se) is preceded by a reset period (Re). During this reset period, a voltage lower than the threshold voltage is applied to the pixel to reset the antiferroelectric liquid crystal to the antiferroelectric state. By resetting the state of each pixel immediately before writing necessary information to the pixel, as just described, a good display can be produced with each pixel being unaffected by its previously written state. In FIG. 4, F1, F2, F3, and F4 denote the first, second, third, and fourth frames, respectively. A white display is produced in the first and second frames, while a black display is produced in the third and fourth frames. As shown in the figure, the voltage polarity is usually reversed from one frame to the next.

When driving the liquid crystal for color display utilizing the successive additive color mixing phenomenon, the time during which the light emitting device mounted as a light source behind the liquid crystal shutter emits light of one particular color is defined as TS, as previously described. In this case, if the time TS is made shorter than about 20 ms, changes in the color of light emitted from the light emitting device will not be perceived as flicker by the human eye when the R, G, and B colored lights are sequentially emitted from the light emitting device.

Figure 5:
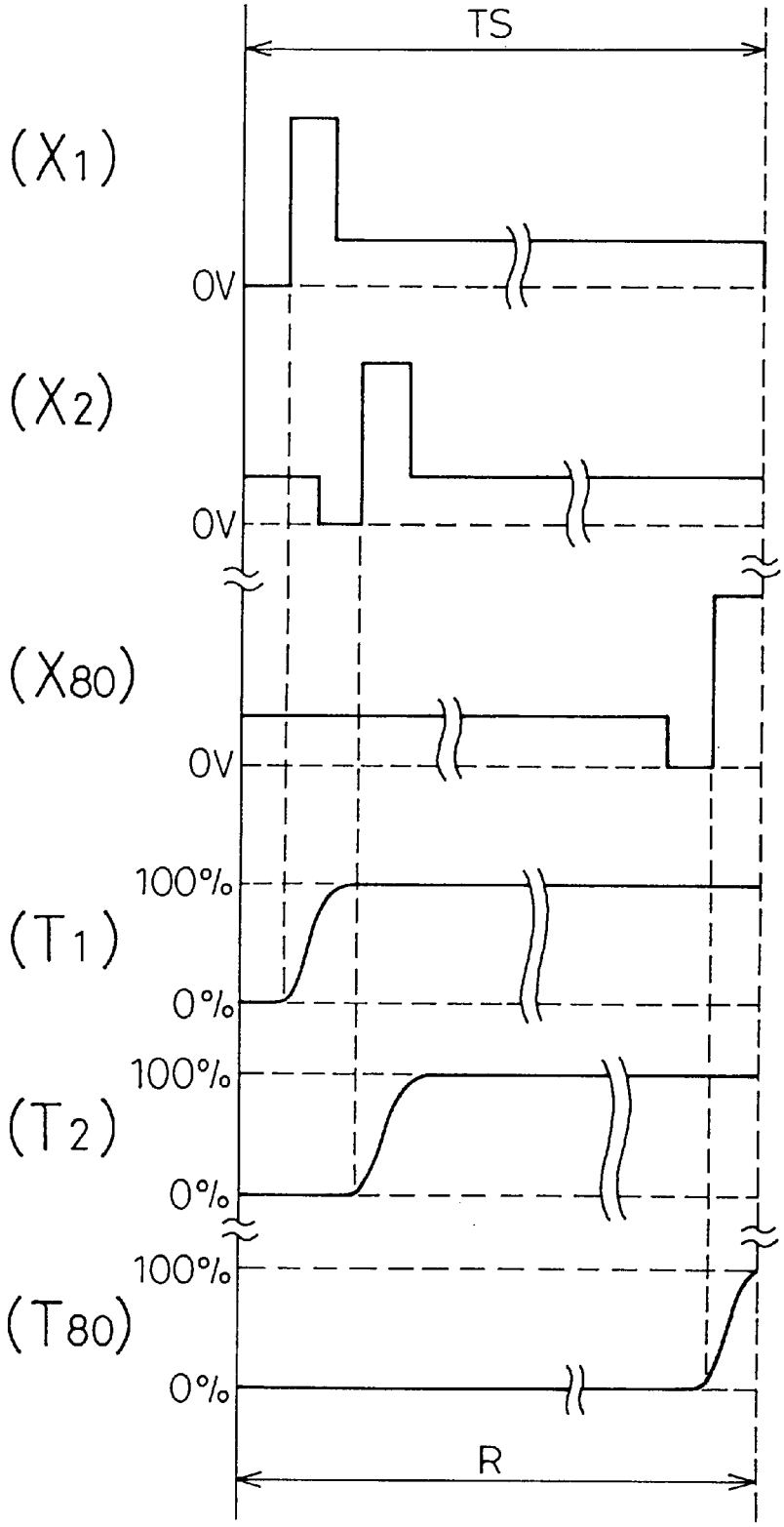
FIG. 5 is a diagram showing voltage waveforms applied to a plurality of scanning electrodes and their corresponding light transmission amounts, according to the prior art driving method.

When the liquid crystal is driven to produce a color display utilizing the successive additive color mixing phenomenon by employing the prior art antiferroelectric liquid crystal driving method, the amount of light transmitted through a pixel during the time TS varies depending on which scan line the pixel is located, as previously described. Consider, for example, a case where the entire liquid crystal display screen is displayed in white. In this case, since the display color is white, the liquid crystal is driven so that the light transmittance for each of R, G, and B becomes 100% for all pixels. FIG. 5 shows the voltage waveforms applied to the respective scanning electrodes during the time TS that, for example, R is being emitted. G is emitted for the next duration of time TS, followed by the emission of B for the duration of time TS, and the liquid crystal is driven accordingly for the respective durations of time TS to produce the desired color (in this case, white) for display. The waveforms shown in FIG. 5 are the same as the driving waveforms applied to the scanning electrodes during the period F1 in FIG. 4. (X1), (X2), . . . , (X80) are the waveforms applied to the scanning electrodes X1, X2, . . . , X80, respectively, and (T1), (T2), . . . , (T80) are the waveforms showing how the light transmittance changes for the pixels associated with the respective scanning electrodes X1, X2, . . . , X80. As can be seen from FIG. 5, the length of time that the pixels on the scanning electrodes X1, X2, . . . , X80 transmit the light of R during the time that the light of R is being emitted becomes gradually shorter as the scanning progresses from top to bottom and, at (T80), the light of R is transmitted only for a short period near the end. If the length of time that the liquid crystal cell transmits light differs depending on the position of its associated scanning electrode, the color cannot be controlled and the desired color cannot be displayed. For example, in the case of FIG. 5, since the pixels on X80 transmit the light of R only for a short period of time, the amount of transmitted light decreases, reducing the pixel brightness. As a result, the entire screen cannot be displayed with uniform brightness, and a color different from white is displayed.

Figure 6:
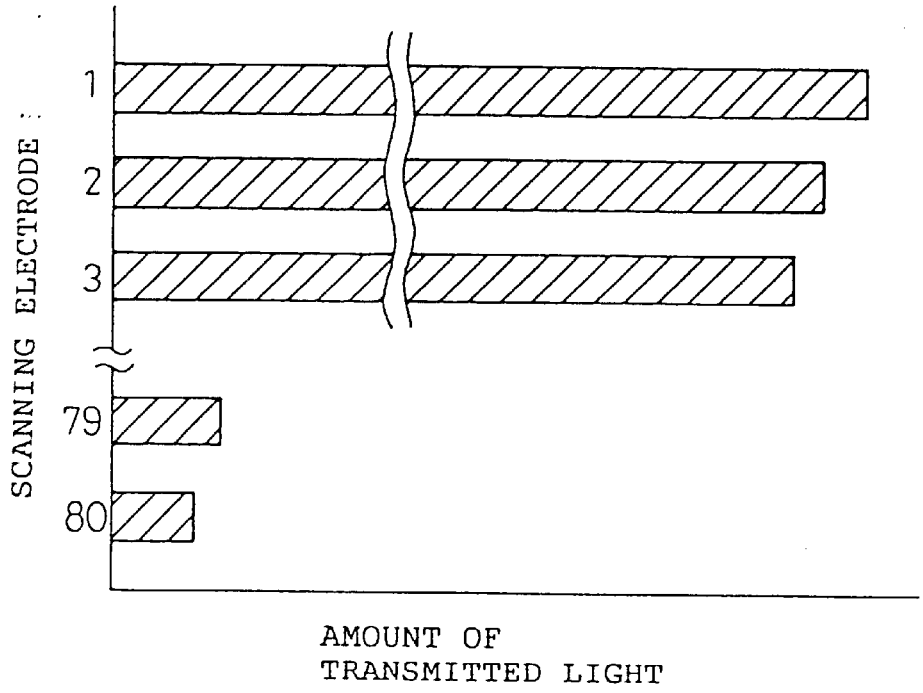
FIG. 6 is a graph showing the amounts of light transmitted through the pixels on the respective scanning electrodes when a white display was produced by the prior art driving method.

FIG. 6 is a graph where the vertical axis represents the scanning electrode location and the horizontal axis represents the amount of transmitted light (the length of light transmission time) for pixels on the respective scanning electrodes in the case of producing a white display. As can be seen from the graph, the amount of light transmitted through the pixel decreases in increasing order of the scanning electrode location 1, 2, 3, . . . , 79, and 80. Thus, according to the prior art antiferroelectric liquid crystal driving method shown in FIG. 4, the amount of light transmitted by a pixel varies depending on the location of the scanning electrode associated with the pixel. Therefore, if the prior art driving method is employed for a liquid crystal display device that utilizes the successive additive color mixing phenomenon, since the amount of transmitted light varies from one scanning line to the next, the color cannot be controlled accurately, especially when the number of scanning electrodes is large, rendering it impossible to produce a good display by maintaining the entire screen with uniform brightness.

The present invention is aimed at resolving the above-described problem, and provides an antiferroelectric liquid crystal display that uses the successive additive color mixing phenomenon for color display and that can display the entire screen with uniform brightness and can achieve the display of the desired color. The invention also provides a method of driving such an antiferroelectric liquid crystal display.

Embodiment 1

Figure 7:
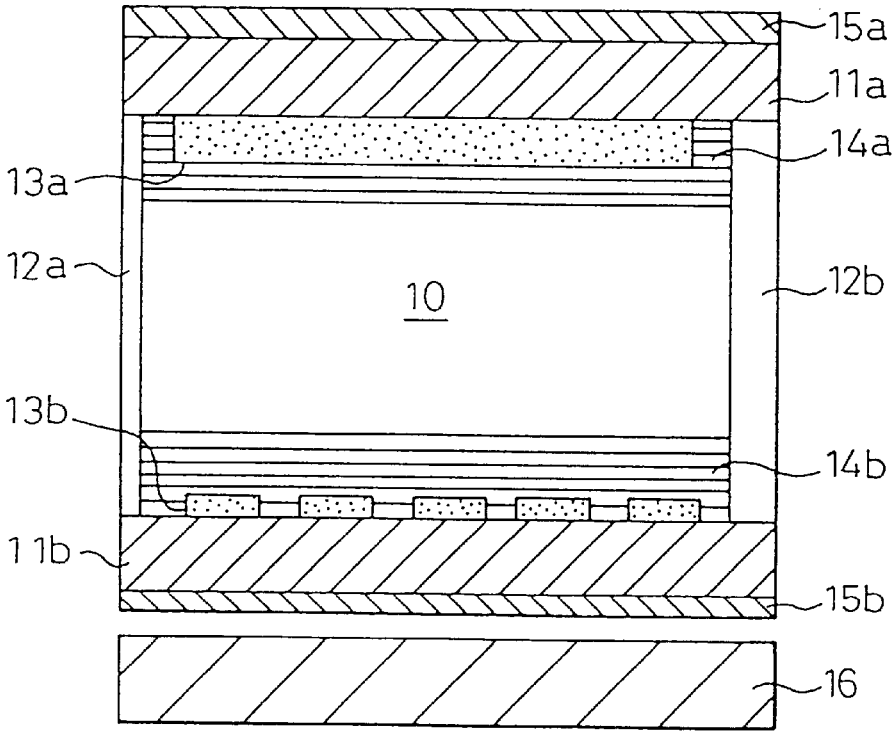
FIG. 7 is a diagram showing the structure of a liquid crystal display used in the embodiments of the present invention.

Embodiments of the present invention will be described in detail below with reference to drawings. FIG. 7 is a diagram showing the structure of a liquid crystal panel used in the embodiments of the present invention. The liquid crystal panel used in the embodiments comprises: a pair of glass substrates 11*a* and 11*b* between which an antiferroelectric liquid crystal layer 10 with a thickness of about 2 $\mu$m is sandwiched; and sealing members 12*a* and 12*b* for bonding the two glass substrates together. On the opposing surfaces of the glass substrates 11*a* and 11*b* are formed electrodes 13*a* and 13*b*, which are coated with polymeric alignment films 14*a* and 14*b*, respectively, that are processed by rubbing. On the outside surface of one glass substrate is disposed a first polarizer 15*a* with its polarization axis oriented parallel to the rubbing axis, while on the outside surface of the other glass substrate, a second polarizer 15*b* is arranged with its polarization axis oriented at 90° to the polarization axis of the first polarizer 15*a*. An LED, as a backlight 16, that emits three colored lights (R, G, and B) is mounted behind the thus structured liquid crystal device. The backlight 16 is operated to emit light of R, G, and B in this order, each color for a duration of about 16.7 ms.

The electrode arrangement in the liquid crystal panel is the same as that shown in FIG. 3, and the scanning electrodes and signal electrodes are arranged as shown in FIG. 3 . X1, X2, . . . , Xn are the scanning electrodes, and Y1, Y2, . . . , Ym are the signal electrodes. Shaded portions where the scanning electrodes and signal electrodes intersect are pixels (A11, Anm). In the electrode arrangement shown in FIG. 3, there are 80 scanning electrodes and 220 signal electrodes, but their numbers can be changed arbitrarily.

Figure 8:
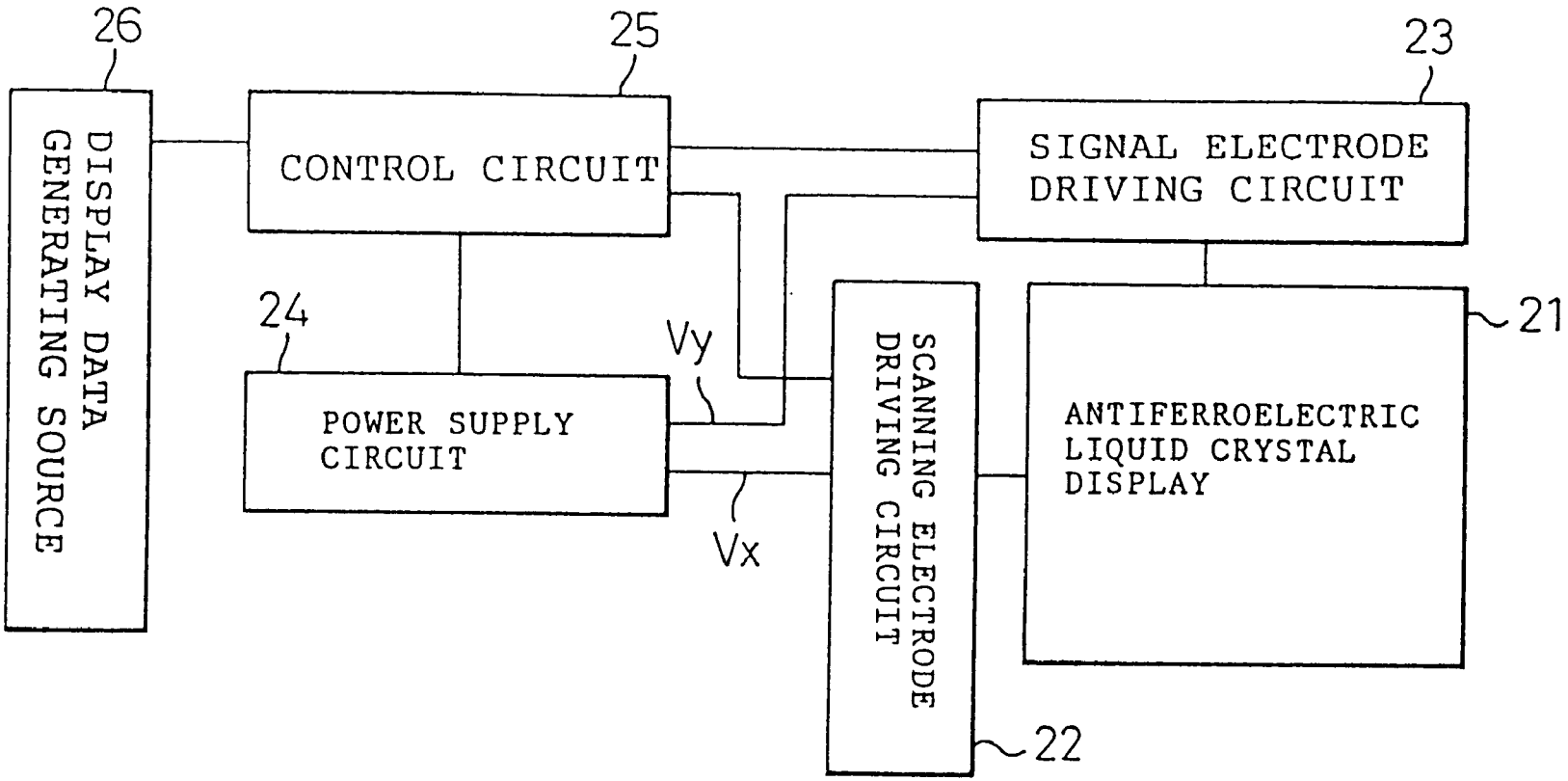
FIG. 8 is a block diagram showing a driving circuit configuration for the antiferroelectric liquid crystal display of the present invention.

FIG. 8 is a block diagram showing a driving circuit configuration for an antiferroelectric liquid crystal display. In the antiferroelectric liquid crystal display 21 shown in the figure, the scanning electrodes to which scanning signals are applied are connected to a scanning electrode driving circuit 22, and the signal electrodes to which display signals are applied are connected to a signal electrode driving circuit 23. A power supply circuit 24 supplies the scanning electrode driving circuit 22 with a voltage Vx necessary for driving the scanning electrodes of the liquid crystal display, and the signal electrode driving circuit 23 with a voltage Vy necessary for driving the signal electrodes of the liquid crystal display. A control circuit 25, based on a signal from a display data generating source 26, supplies signals to the scanning electrode driving circuit 22 and signal electrode driving circuit 23 which then supply signals, respectively consisting of the voltages Vx and Vy, to the liquid crystal display 21 in accordance with the respectively supplied signals.

Figure 9:
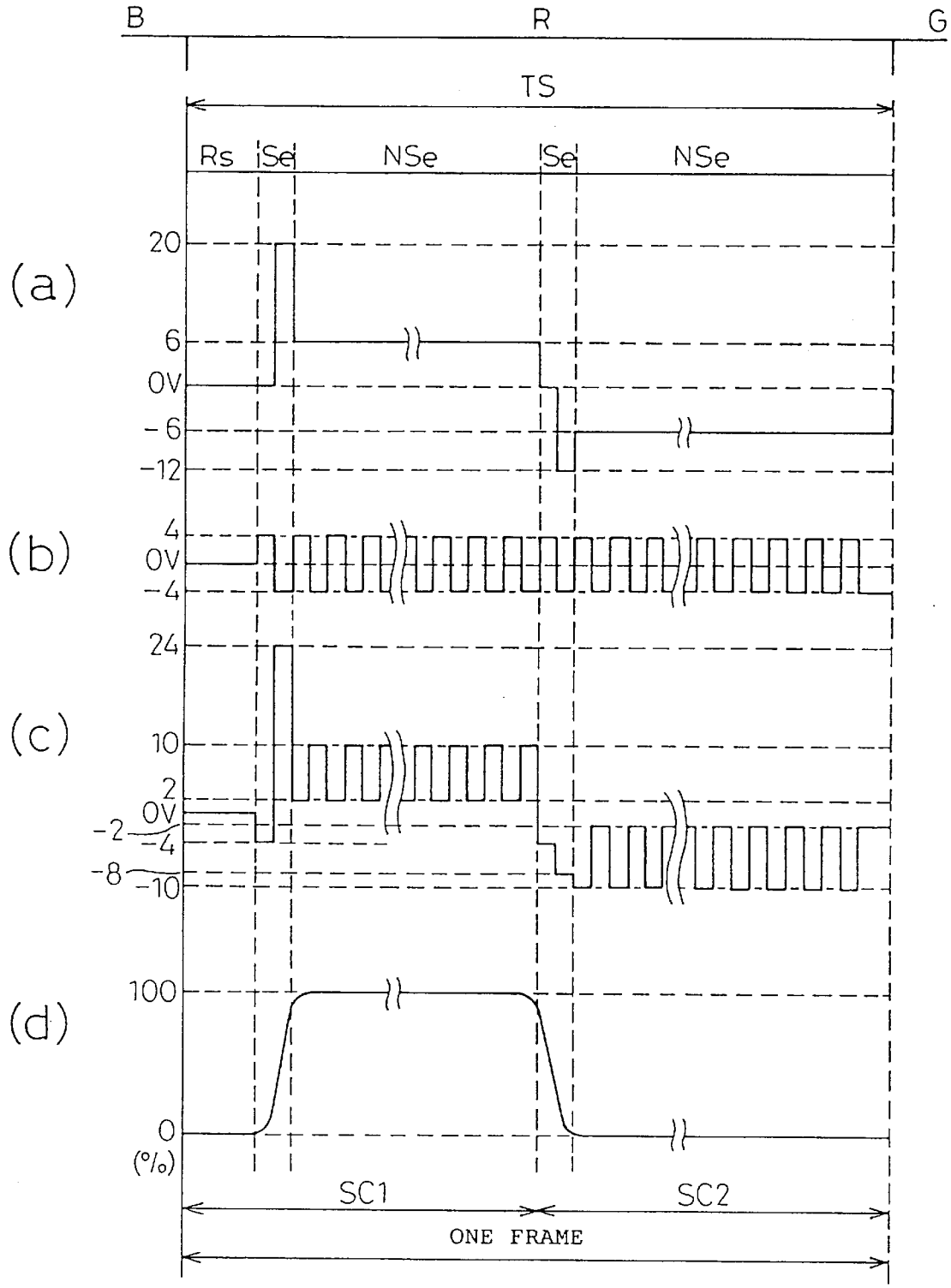
FIG. 9 is a diagram showing driving waveforms and the amount of transmitted light in a first embodiment of the present invention.

FIG. 9 is a diagram showing a first embodiment of the present invention. The diagram of this embodiment shows a voltage waveform (a) applied to the scanning electrode (Xn), a voltage waveform (b) applied to the signal electrode (Ym), and a composite driving voltage waveform (c) applied to the pixel (Anm) located at their intersection, along with the corresponding change (d) in the amount of transmission (T) of light from the backlight, during the time TS when the antiferroelectric liquid crystal display of the present invention is driven in white display mode. The liquid crystal driving waveforms used in the present invention represent the waveforms applied during the scanning period of time TS when light of one of the three primary colors, for example, R, is being emitted. The scanning period comprises two periods. The first period (SC1) is made up of a selection period and a non-selection period, the selection period (Se) consisting of two phases and the non-selection period (NSe) constituting the remainder of the first period. The second period (SC2) is likewise made up of a selection period and a non-selection period, the selection period (Se) consisting of two phases and the non-selection period (NSe) constituting the remainder of the second period. The pulse width of one phase is chosen to be about 70 $\mu$s. In the first period (SC1), a pulse of a voltage value of 0 is applied to the scanning electrode (Xn) in the first phase of the selection period (Se) and a pulse of a voltage value of 20 is applied to the same electrode in the second phase, while a retention voltage of 6 V is applied during the non-selection period (NSe). In the second period (SC2), a pulse of a voltage value of 0 is applied to the scanning electrode (Xn) in the first phase of the selection period (Se) and a pulse of a voltage value of −12 V is applied to the same electrode in the second phase, while a retention voltage of −6 V is applied during the non-selection period (NSe). A voltage waveform of ±4 is applied to the signal electrode (Ym), depending on the display state to be produced.

In the driving voltage waveforms described above, a reset period (Rs) for displaying all pixels in black state may be provided immediately preceding the first period (SC1), as shown in FIG. 9.

In the embodiment shown in FIG. 9, the driving voltage waveforms and the amount of transmitted light are shown when the antiferroelectric liquid crystal display is driven in white display mode. In this case, since a voltage of 24 V (selection pulse) is applied as the composite voltage waveform (Anm) during the second phase of the selection period (Se) in the first period (SC1), the antiferroelectric liquid crystal is placed in the first ferroelectric state, and the amount of transmitted light (T) increases nearly to 100% in the selection period (Se). In the non-selection period (NSe), the antiferroelectric liquid crystal is held in the ferroelectric state, thus maintaining the light transmittance at 100% to produce the white display. In the second period (SC2), the composite voltage waveform consisting of a voltage of −4 V in the first phase and a voltage of −8 V in the second phase is applied during the selection period (Se). As a result, the antiferroelectric liquid crystal makes a transition from the ferroelectric state to the antiferroelectric state, so that the amount of transmitted light decreases to 0% and the black display is thus produced. As shown in FIG. 9, the period during which the light, in this case, the light of R, is transmitted 100% is the first period (SC1).

Figure 10:
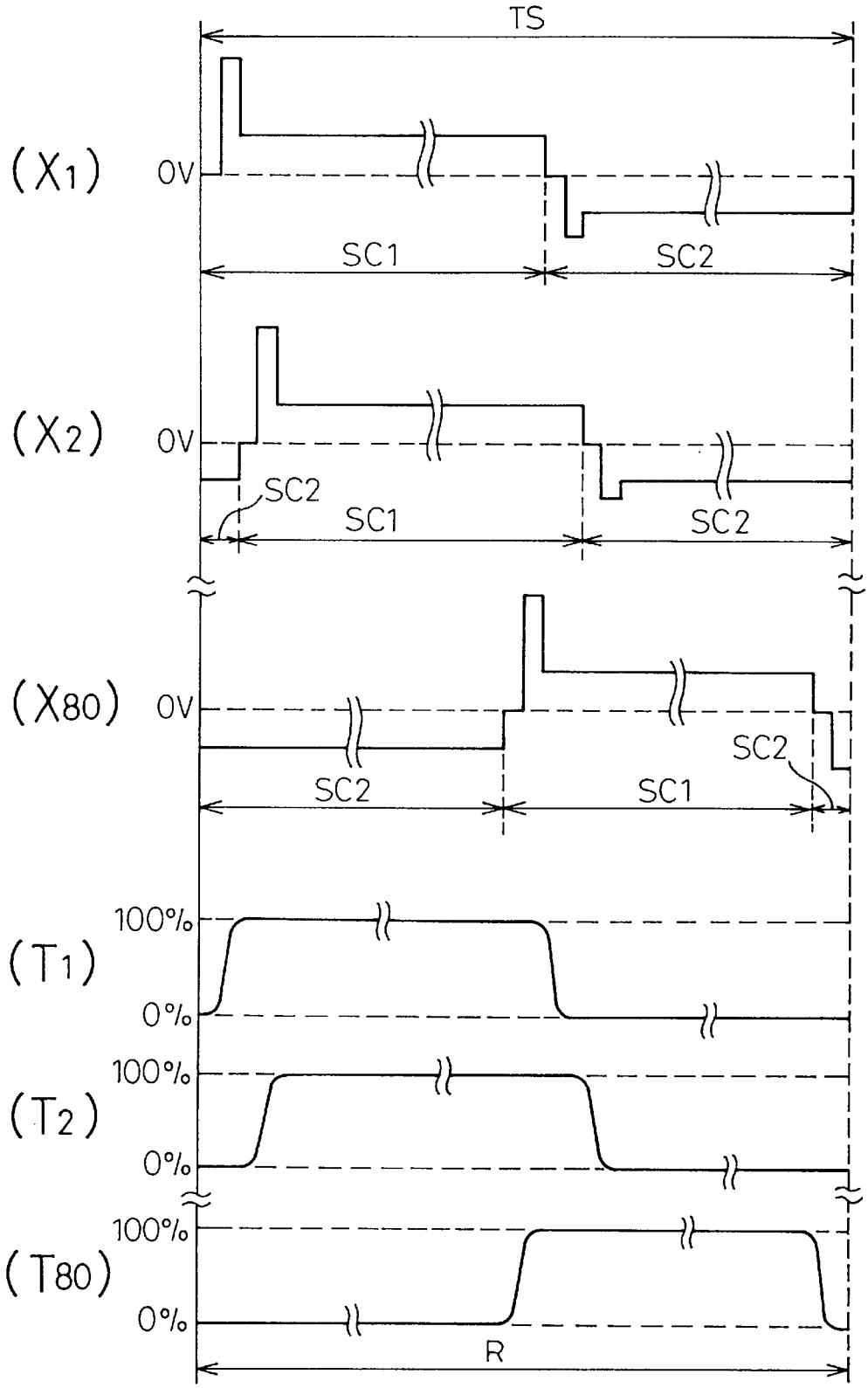
FIG. 10 is a graph showing the driving waveforms in further detail in relation to the amount of transmitted light according to the first embodiment of the present invention.

While FIG. 9 showed the voltage waveform applied to one particular scanning electrode, FIG. 10 shows the voltage waveforms (X1), (X2), and (X80) applied to the first, second, and 80th scanning electrodes X1, X2, and X80 during the time TS that R is being emitted when the antiferroelectric liquid crystal display of the present invention is driven in a white display mode, and the waveforms (T1), (T2), and (T80) showing the changes in transmittance for the pixels on the respective scanning electrodes during the period TS. In the figure, each of the voltage waveforms applied to the scanning electrodes X1, X2, and X80 is the same as the voltage waveform (a) applied to the scanning electrode Xn in FIG. 9, and the voltage waveforms are displaced by 1/N from one scanning electrode to the next, where N is the number of scanning electrodes. These voltage waveforms (X1), (X2), and (X80) are each divided into the first period (SC1) and the second period (SC2), as in the case of FIG. 9. The voltage waveform (X1) applied to the scanning electrode X1 is divided at its midpoint between the first and second periods. On the other hand, in the case of the voltage waveforms (X2) and (X80) for the scanning electrodes X2 and X80, the first period SC1 is located somewhere near the middle, and the second period is located before and after that. As a result, though the position where the transmittance is at 100% is displaced along the time TS, the amount of light transmitted through the pixel becomes equal for all the scanning electrodes, as shown by the transmittance waveforms (T1), (T2), and (T80). FIG. 10 shows the transmittance waveforms (T1), (T2), and (T80) for the pixels associated with the scanning electrodes X1, X2, and X80, but it will be noted that the pixel transmittance waveforms for other scanning electrodes are approximately the same as those shown in FIG. 10, so that the amount of transmitted light is also the same for all other scanning electrodes.

As shown in FIG. 10, according to the driving method of the present invention, the period (SC2) during which the antiferroelectric liquid crystal is held in the antiferroelectric state (black display state) is provided within the time TS during which the light emitting device emits light of one particular color. Accordingly, the first period (SC1) during which the light is transmitted is displaced by an amount equal to the selection period Se from one scanning line to the next, as shown in FIG. 10, and at the same time, the second period (black display period) during which the light is not transmitted is shifted accordingly for each scanning line. As a result, the length of the period during which the light is transmitted through the pixels is the same for all the scanning lines. In FIG. 9, the reset period Rs was provided, but the reset period Rs may or may not be provided. In the scanning voltage waveforms shown in FIG. 10, the reset period Rs is not provided. In the present invention, the second period during which the antiferroelectric liquid crystal is held in the antiferroelectric state should only be provided somewhere within the period TS, but the best result can be obtained if the second period is set equal in length to one half of the period TS.

Figure 11:
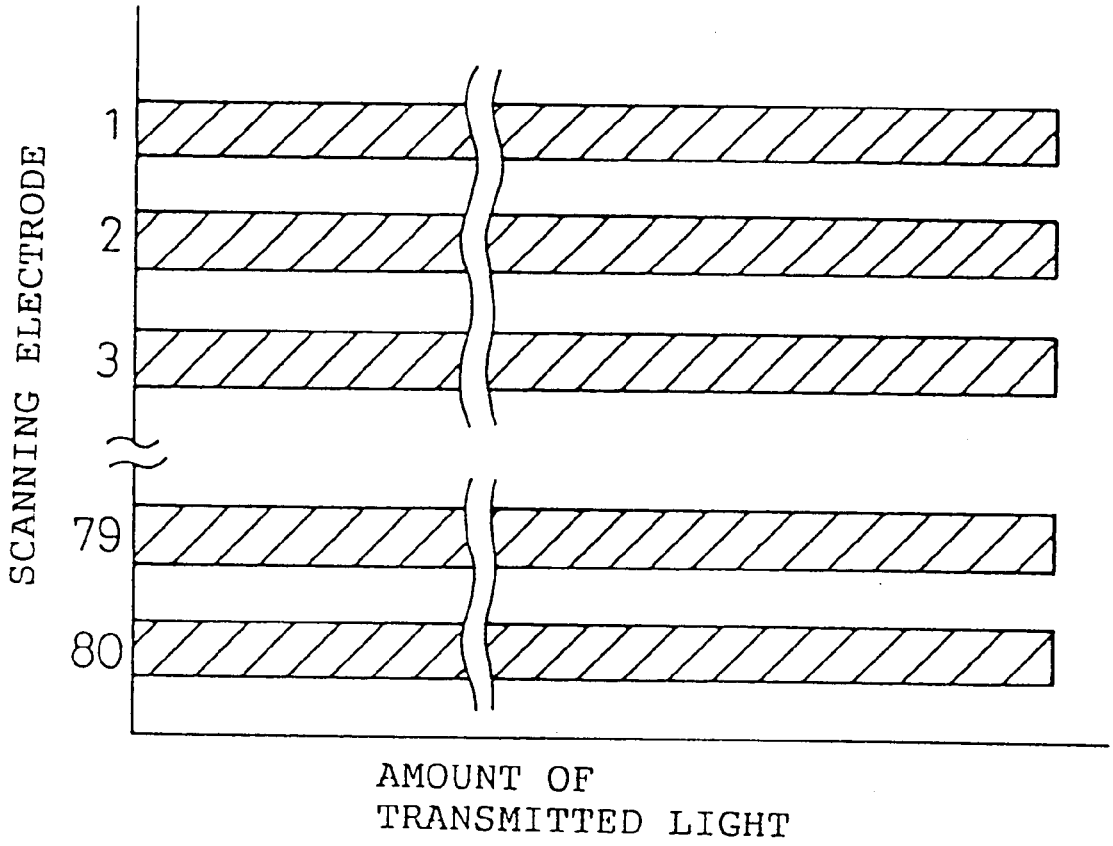
FIG. 11 is a graph showing the amounts of light transmitted through the pixels on the respective scanning electrodes when a white display was produced by the driving method according to the first embodiment of the present invention.

FIG. 11 is a graph showing the amounts of light transmitted through the pixels on the respective scanning electrodes when the liquid crystal driving method of the present invention is employed. In the graph of FIG. 11, the vertical axis represents the scanning electrode location and the horizontal axis the amount of light transmitted through the pixels on each scanning electrode during the time TS when the white display was produced. The time TS during which one backlight color was illuminated was chosen to be 16.7 ms. The length of time that the pixel transmitted light was about 8.3 ms for each scanning electrode. It was thus possible to obtain the desired color display state and achieve a uniform brightness display screen free from nonuniformity in brightness.

Embodiment 2

In the first embodiment, driving waveforms different from the liquid crystal driving waveforms shown in FIG. 4 were used. However, the prior art problem can also be solved by using the liquid crystal driving waveforms shown in FIG. 4 that were used in the prior art.

Figure 12:
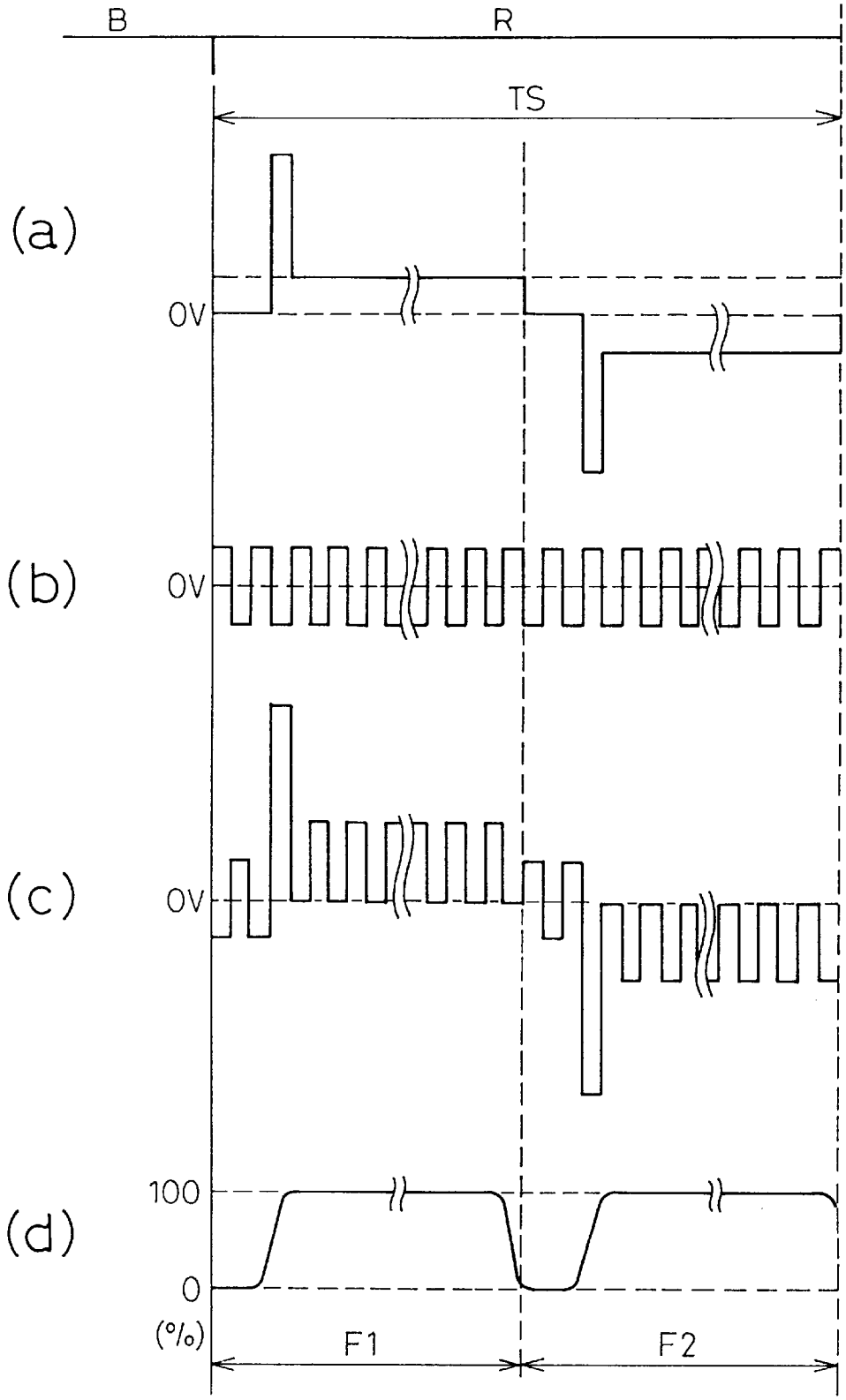
FIG. 12 is a diagram showing driving waveforms and the amount of transmitted light in a second embodiment of the present invention.

FIG. 12 is a diagram showing the driving waveforms for two frames in FIG. 4. These driving waveforms are identical to the traditionally used waveforms, and the waveforms are the same for the first frame (F1) as for the second frame (F2), except that the polarity is reversed. In the figure, (a) is the voltage waveform applied to the scanning electrode (Xn), (b) is the voltage waveform applied to the signal electrode (Ym), and (c) is the composite voltage waveform applied to the pixel. The light transmittance of the liquid crystal varies with the voltage waveform applied to the pixel. The driving waveforms shown here are applicable when driving the screen in white display mode.

In the second embodiment of the present invention, the driving waveforms shown in FIG. 12 are applied to the liquid crystal while light of one color (for example, R) is being emitted. In the scanning period of the first frame (F1), the voltage waveform (a) is applied in sequence to the scanning electrodes, starting at the first electrode and ending at the N-th electrode, the waveform being displaced by 1/N from one electrode to the next. In the second frame (F2), on the other hand, the voltage waveform (a) is applied in the reverse order, starting at the N-th electrode and ending at the first electrode, with a displacement of 1/N from one electrode to the next. Accordingly, in the first frame (F1), the amount of light transmitted through the pixel decreases as the scanning progresses in the order of the scanning electrodes 1, 2, 3, and so on, as explained with reference to FIG. 6. Conversely, in the scanning period of the second frame (F2), the amount of light transmitted through the pixel increases in the order of the scanning electrodes 1, 2, 3, and so on. Therefore, the amount of light transmitted through the pixel, the first and second frames (F1 and F2) combined, becomes the same for all the scanning electrodes. This achieves a uniform brightness display screen free from nonuniformity in brightness. Furthermore, the desired color can be displayed since the color can be controlled accurately.

Figure 13:
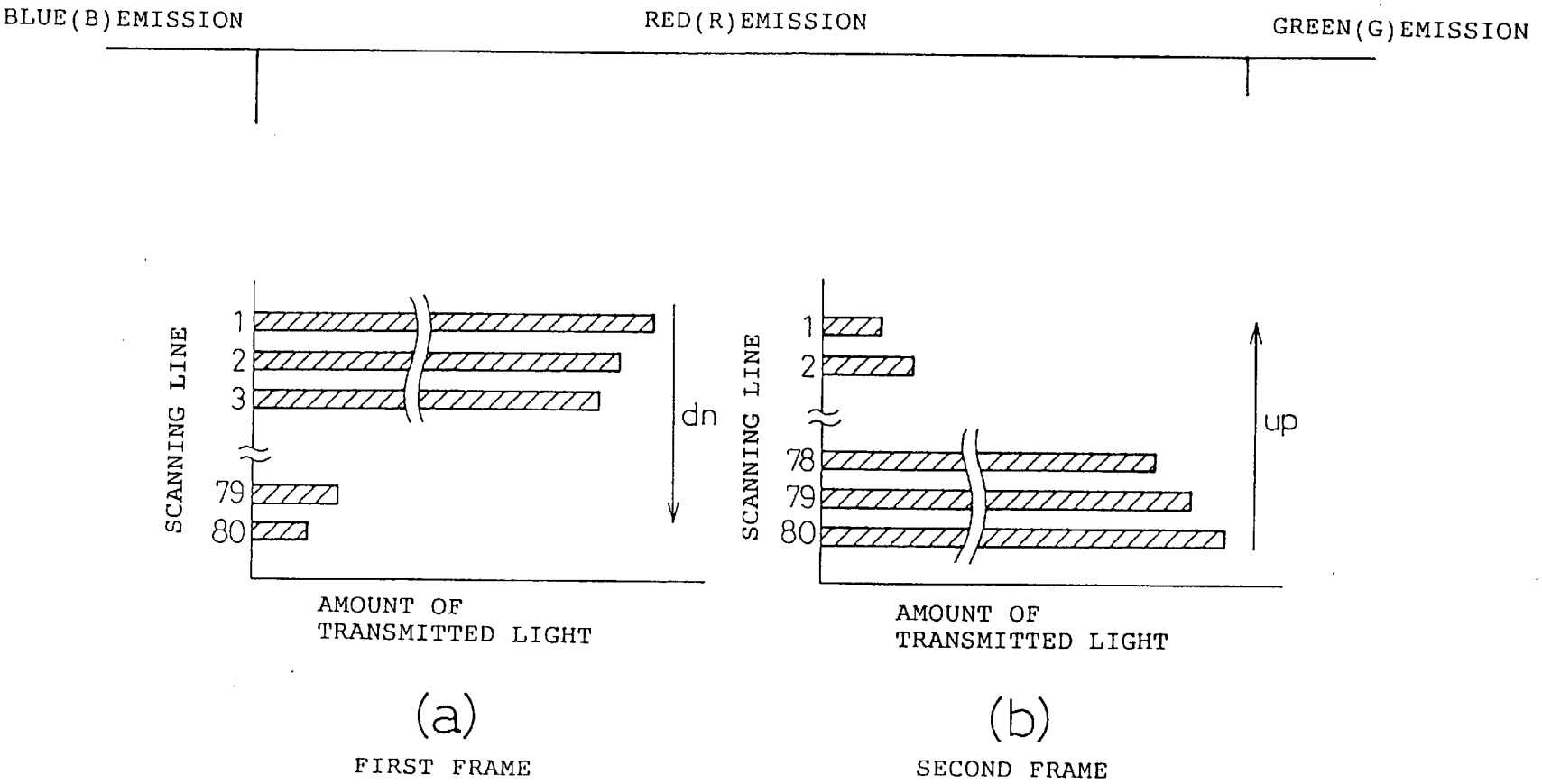
FIG. 13 is a graph showing the amounts of light transmitted through the pixels on the respective scanning electrodes when a white display was produced by the driving method according to the second embodiment of the present invention.

FIG. 13 shows graphs similar to that shown in FIG. 6 but redrawn for the first frame (F1) and the second frame (F2), respectively. The graphs show the case of 80 scanning electrodes. In the first frame, the driving voltage is applied in sequence, starting at the first scanning electrode and ending at the 80th scanning electrode, as shown by arrow dn, and in the second frame, the driving voltage is applied in sequence, starting at the 80th scanning electrode and ending at the first scanning electrode, as shown by arrow up. In the first frame, the amount of light transmitted through the pixel decreases as the scanning progresses from the first to the 80th scanning electrode, as shown in FIG. 13. In the second frame, on the other hand, the amount of light transmitted through the pixel increases in increasing order of scanning electrode number, i.e., from the first to the 80th scanning electrode. The color of light being emitted during the illustrated period is R, and the same driving waveform is applied during the next period of G emission.

In the second embodiment shown in FIG. 12, writing is performed two times during the emission of one color. However, the number of times the writing is performed need not be limited to two, but the writing can be performed an even number of times, such as two times, four times, and 2N times (N is a natural number), according to the response speed of the liquid crystal.

In the above description, during the scanning period of the first frame (F1), that is, during an odd-numbered scanning period, the scanning voltage is applied in sequence, starting at the first scanning electrode and ending at the 80th scanning electrode, and during the scanning period of the second frame (F2), that is, during an even-numbered scanning period, the scanning voltage is applied in sequence, starting at the 80th scanning electrode and ending at the first scanning electrode. However, the order of the scanning voltage application may be reversed from that described above.

Embodiment 3

In the second embodiment, the driving voltage waveforms for a plurality of frames were applied during the period TS that one particular color was being emitted. However, the prior art problem can also be solved in another way by using the same driving waveforms as those shown in FIG. 12.

Figure 14:
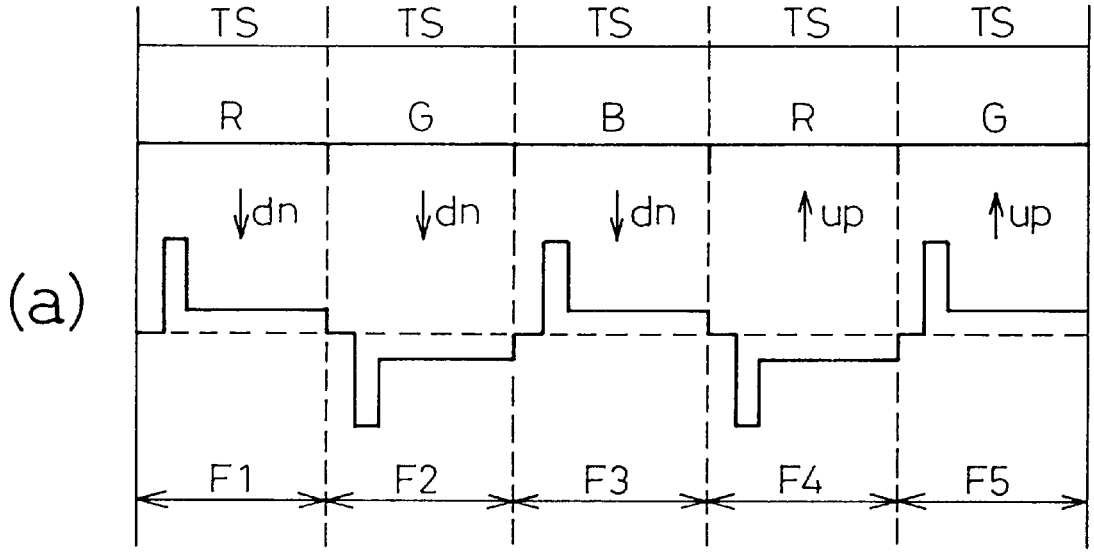
FIG. 14 is a diagram showing driving waveforms in a third embodiment of the present invention.

FIG. 14 is a diagram illustrating a third embodiment of the present invention. FIG. 14 shows the scanning electrode driving voltage (a) for each frame and the color (R, G, or B) being emitted during the corresponding frame period. The waveform (b) applied to the signal electrode, the composite voltage waveform (c), and the transmittance waveform (d) shown in FIG. 12 are not shown here, but the same waveforms are also used here. In the third embodiment, each frame period is made substantially equal to the period TS during which light of one color is emitted, and R, G, and B are emitted in sequence in corresponding relationship with the frames F1, F2, and F3, respectively. When we look at the frames F1 and F4 during which R is emitted, during F1 the driving voltage is applied in sequence, starting at the first scanning electrode and ending at the 80th scanning electrode, as shown by arrow dn, while during F4, the driving voltage is applied in sequence, starting at the 80th scanning electrode and ending at the first scanning electrode, as shown by arrow up.

Figure 15:
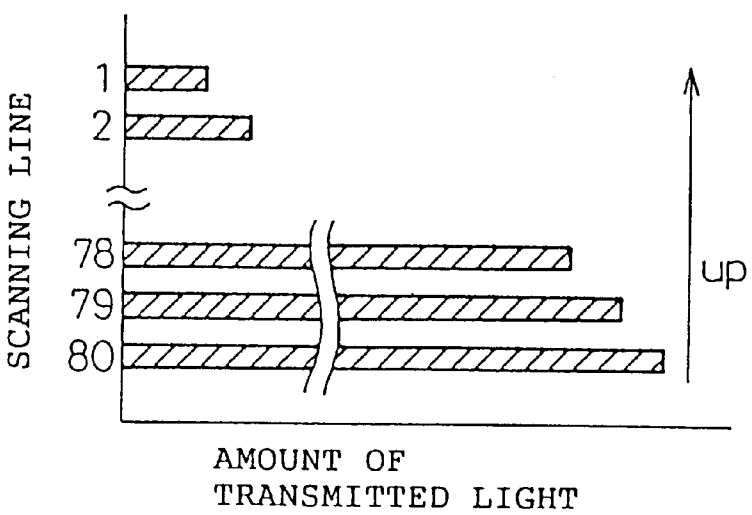
FIG. 15 is a graph showing the amounts of light transmitted through the pixels on the respective scanning electrodes when a white display was produced by the driving method according to the third embodiment of the present invention.
Figure 15:
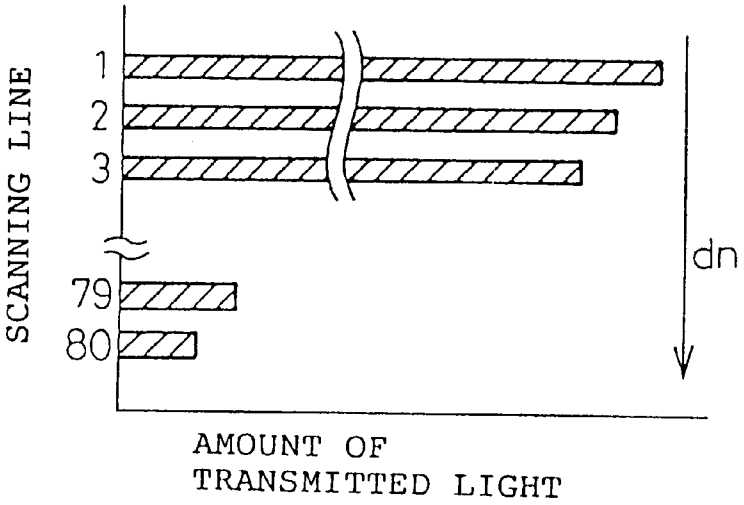

FIG. 15 is a diagram showing the amount of transmitted light when the driving voltage was applied as just described. In comparison, the graphs in FIG. 13 showed the amount of transmitted light when the driving voltage was applied to the scanning electrodes for two frames by reversing the order between the frames during the period that light of one particular color (for example, R) was being emitted. On the other hand, in the case of the graphs shown in FIG. 15, the driving voltage is applied for one frame during the period that light of one particular color (for example, R) is being emitted. It should, however, be noted that for the same color of light (for example, R), the order in which the driving voltage is applied to the scanning electrodes is reversed for the second emission frame from that for the first emission frame, as shown by arrows dn and up. Accordingly, the amount of light transmitted by the pixel, the first R emission frame (F1) and the second R emission frame (F4) combined, becomes the same for all the scanning electrodes, thus eliminating brightness nonuniformity from the display screen and enabling the desired color to be displayed.

What is claimed is:

1. An antiferroelectric liquid crystal display comprising: an antiferroelectric liquid crystal display element which includes an antiferroelectric liquid crystal that is sandwiched between a pair of substrates having at least one electrode deposited on an opposing surface thereof; and a light source which sequentially emits Red, Green, and Blue colors of light, wherein a scanning period during which said light source emits light of one of said Red, Green, and Blue colors is divided into two periods, of which the first period includes a selection period for determining a display state and a non-selection period for holding therethrough the display state selected during said selection period, and the second period, constituting the remainder of said scanning period, includes a selection period for forcing said display state into a black display state and a non-selection period for holding therethrough the black display state selected during said selection period.

2. An antiferroelectric liquid crystal display as claimed in claim 1, wherein said antiferroelectric liquid crystal is capable of exhibiting a first ferroelectric state, a second ferroelectric state that is entered when a voltage opposite in polarity to that for said first ferroelectric state is applied, and an antiferroelectric state, and wherein a voltage value of a composite voltage waveform produced by compositing a scanning voltage waveform and a signal voltage waveform applied during said selection period in said second period is less than a threshold voltage value at which said antiferroeletric liquid crystal makes a transition to said first or said second ferroelectric state.

3. An antiferroelectric liquid crystal display as claimed in claim 1, wherein the signal voltage waveform applied during said second period is always set as a black display producing signal voltage waveform.

4. An antiferroelectric liquid crystal display as claimed in any one of claims 1 to 3, wherein said first period and said second period are substantially equal in length.

5. An antiferroelectric liquid crystal display as claimed in any one of claims 1 to 3, wherein said first period is located somewhere near the middle of said scanning period.

6. An antiferroelectric liquid crystal display comprising:

an antiferroelectric liquid crystal display element which includes an antiferroelectric liquid crystal that is sandwiched between a pair of substrates having N scanning electrodes and M signal electrodes deposited respectively on the opposing surfaces thereof; and a light source which sequentially emits Red, Green, and Blue colors of light, wherein a period during which said light source emits light of one of said Red, Green, and Blue colors is divided into an even number of scanning periods, wherein, in an odd-numbered scanning period, one of forward scanning and backward scanning is performed, and in an even-numbered scanning period, the other of the forward scanning and the backward scanning is performed, and wherein the forward scanning is performed by scanning said scanning electrodes forward, starting at the first scanning electrode and progressing toward the N-th scanning electrode and the backward scanning is performed by scanning said scanning electrodes backward, starting at the N-th scanning electrode and progressing toward the first scanning electrode.

7. An antiferroelectric liquid crystal display as claimed in claim 6, wherein in said odd-numbered scanning period, the forward scanning is performed and, in said even-numbered scanning period, the backward scanning is performed.

8. A method of driving an antiferroelectric liquid crystal display that comprises: an antiferroelectric liquid crystal display element which includes an antiferroelectric liquid crystal that is sandwiched between a pair of substrates having at least one electrode deposited on an opposing surface thereof; and a light source which sequentially emits Red, Green, and Blue colors of light, wherein a scanning period during which said light source emits light of one of said Red, Green, and Blue colors is divided into two periods, in the first period of which a display state is determined, said first period having a selection period and a non-selection period for holding therethrough the display state selected during said selection period, and in the second period, constituting the remainder of said scanning period, said display state is forced into a black display state.

9. A method of driving the antiferroelectric liquid crystal display as claimed in claim 8, wherein said antiferroelectric liquid crystal is capable of exhibiting a first ferroelectric state, a second ferroelectric state that is entered when a voltage opposite in polarity to that for said first ferroelectric state is applied, and an antiferroelectric state, and wherein a voltage value of a composite voltage waveform produced by compositing a scanning voltage waveform and a signal voltage waveform applied during a selection period in said second period is less than a threshold voltage value at which said antiferroelectric liquid crystal makes a transition to said first or said second ferroelectric state.

10. A method of driving the antiferroelectric liquid crystal display as claimed in claim 8, wherein the signal voltage waveform applied during said second period is always set as a black display producing signal voltage waveform.

11. A method of driving the antiferroelectric liquid crystal display as claimed in any one of claims 8 to 10, wherein said first period and said second period are substantially equal in length.

12. A method of driving an antiferroelectric liquid crystal display, the antiferroelectic liquid crystal display comprising an antiferroelectric liquid crystal antiferroelectric liquid crystal that is sandwiched between a pair of substrates having N scanning electrodes and M signal electrodes deposited respectively on the opposing surfaces thereof, the method comprising the steps of:

dividing a period during which said light source emits light of one of said Red, Green, and Blue colors into even number of scanning periods; and in an odd-numbered scanning period, performing one of forward scanning and backward scanning; and in an even-numbered scanning period, performing the other of the forward scanning and the backward scanning, wherein the forward scanning is performed by scanning said scanning electrodes forward, starting at the first scanning electrode and progressing toward the N-th scanning electrode and the backward scanning is performed by scanning said scanning electrodes backward, starting at the N-th scanning electrode and progressing toward the first scanning electrode.

13. A method of driving the antiferroelectric liquid crystal display as claimed in claim 12, wherein in said odd-numbered scanning period, the forward scanning is performed and, in said even-numbered scanning period, the backward scanning is performed.

14. An antiferroelectric liquid crystal display comprising: an antiferroelectric liquid crystal display element which includes an antiferroelectric liquid crystal that is sandwiched between a pair of substrates having at least one scanning electrode and at least one signal electrode deposited respectively on the opposing surfaces thereof; a control circuit operatively connected to said scanning electrode and said signal electrode; and a light source which successively emits a plurality of different colors of light, wherein a scanning period during which said light source emits light of one of said plurality of colors is divided into two periods, of which the first period includes a selection period for determining a display state and a non-selection period for holding therethrough the display state selected during said selection period, wherein the second period, constituting the remainder of said scanning period, includes a selection period for forcing said display state into a black display state and a non-selection period for holding therethrough the black display state selected during said selection period, and wherein said first period is located somewhere near the middle of said scanning period.

15. A method for driving an antiferroelectric liquid crystal display having an antiferroelectric liquid crystal display element which includes an antiferroelectric liquid crystal that is sandwiched between a pair of substrates have at least one scanning electrode and at least one signal electrode deposited respectively on the opposing surfaces thereof; a control circuit operatively connected to said scanning electrode and said signal electrode; and a light source which successively emits a plurality of different colors of light, the method comprising the steps of:

providing a scanning period during which said light source emits light of one of said plurality of colors is divided into two periods, wherein the first period includes a selection period for determining a display state and a non-selection period for holding therethrough the display state selected during said selection period, and wherein the second period, constituting the remainder of said scanning period, includes a selection period for forcing said display state into a black display state and a non-selection period for holding therethrough the black display state selected during said selection period, and locating said first period somewhere near the middle of said scanning period.

* * * * *